US011313631B2

(12) United States Patent
Chen et al.

(10) Patent No.: US 11,313,631 B2
(45) Date of Patent: Apr. 26, 2022

(54) COMPOSITE HEAT SINK HAVING ANISOTROPIC HEAT TRANSFER METAL-GRAPHITE COMPOSITE FINS

(71) Applicant: HFC Industry Limited, Hong Kong (HK)

(72) Inventors: Xiaohua Chen, Hong Kong (HK); Chi Ho Kwok, Hong Kong (HK); Chenmin Liu, Hong Kong (HK); Ai Xiang Sun, Hong Kong (HK); Lanyue Dou, Hong Kong (HK)

(73) Assignee: HFC Industry Limited, Hong Kong (HK)

( * ) Notice: Subject to any disclaimer, the term of this patent is extended or adjusted under 35 U.S.C. 154(b) by 0 days.

(21) Appl. No.: 16/921,970

(22) Filed: Jul. 7, 2020

(65) Prior Publication Data

US 2022/0011059 A1 Jan. 13, 2022

(51) Int. Cl.

| | |
|---|---|
| ***F28F 3/02*** | (2006.01) |
| ***F28F 3/04*** | (2006.01) |
| ***F28F 21/02*** | (2006.01) |
| ***F28F 21/08*** | (2006.01) |
| ***F28D 21/00*** | (2006.01) |

(52) U.S. Cl.

CPC ..... *F28F 3/025* (2013.01); *F28F 3/04* (2013.01); *F28F 21/02* (2013.01); *F28F 21/085* (2013.01); *F28D 2021/0029* (2013.01)

(58) Field of Classification Search

CPC ..... F28F 1/20; F28F 3/06; F28F 2013/001; F28F 21/02; F28F 21/084; F28F 21/085; F28F 2255/18; F28F 2275/02; F28F 2275/025; F28D 2021/0029; H01L 23/373; H01L 23/3732; H01L 23/3733; H01L 23/3737; H05K 7/2039

See application file for complete search history.

(56) References Cited

U.S. PATENT DOCUMENTS 5,008,737 A * 4/1991 Burnham ..... C22C 26/00 165/905
5,130,771 A * 7/1992 Burnham ..... C22C 26/00 165/905
5,642,779 A * 7/1997 Yamamoto ..... H01L 21/4882 165/185

(Continued)

OTHER PUBLICATIONS

The_Enginnering_ToolBox_Coefficients_of_Linear_Thermal_Expansion.pdf (Year: 2021).*

*Primary Examiner* — Paul Alvare
*Assistant Examiner* — Jose O Glass-Quinones
(74) *Attorney, Agent, or Firm* — Idea Intellectual Limited; Margaret A. Burke; Sam T. Yip

(57) ABSTRACT

A composite server heat sink with a metal base having a thermal conductivity of at least 200W/mK. Plural fins extend from the metal base, each fin having an anisotropic thermal conductivity in a range of approximately 300 to 650 W/mK in a longitudinal direction of the fin and less than approximately 30 W/mK in a widthwise direction of the fin. Each fin includes graphite in an amount of approximately 45-70 wt. %, diamond in an amount of approximately 2.5 to 10 wt. % with the balance comprising a metal selected from one or more of copper and aluminum. To create the anisotropic thermal properties, the graphite is aligned along the longitudinal direction of the fin.

12 Claims, 10 Drawing Sheets

(56) References Cited

U.S. PATENT DOCUMENTS 5,791,045 A * 8/1998 Yamamoto ..... H01L 21/4882 257/E23.103
5,886,407 A * 3/1999 Polese ..... B22F 7/062 257/706
5,944,097 A * 8/1999 Gungor ..... H05K 1/0203 165/185
5,972,737 A * 10/1999 Polese ..... B22F 1/0003 257/E23.105
6,238,454 B1 * 5/2001 Polese ..... B22F 1/0003 257/E23.112
6,309,583 B1 * 10/2001 Feldstein ..... C23C 24/10 264/114
6,538,892 B2 * 3/2003 Smalc ..... H01L 23/3672 165/80.3
6,592,687 B1 * 7/2003 Lee ..... C22C 21/04 148/418
6,684,501 B2 * 2/2004 Ellsworth, Jr. ..... F28F 3/02 165/185
6,714,415 B1 * 3/2004 Shah ..... H01L 23/467 165/185
6,749,010 B2 * 6/2004 Getz, Jr. ..... F28F 3/02 165/185
6,771,508 B1 * 8/2004 Ghosh ..... F28F 3/022 165/185
6,886,249 B2 * 5/2005 Smalc ..... H01L 21/4882 165/185
6,918,970 B2 * 7/2005 Lee ..... C22C 21/04 148/418
6,987,318 B2 * 1/2006 Sung ..... H01L 23/373 257/720
7,384,821 B2 * 6/2008 Sung ..... H01L 23/373 257/E23.111
8,085,531 B2 * 12/2011 Lemak ..... H01L 23/4006 361/679.54
8,453,916 B2 * 6/2013 Hu ..... H01L 23/3736 228/121
8,772,925 B2 * 7/2014 Noda ..... H01L 24/83 257/706
8,998,458 B2 * 4/2015 Tankala ..... F21S 41/192 362/373
9,346,991 B2 * 5/2016 Arzberger ..... H01B 1/02
9,922,910 B2 * 3/2018 Otremba ..... H01L 21/4825
2002/0166654 A1 * 11/2002 Smalc ..... H01L 23/3738 165/80.2
2003/0019104 A1 * 1/2003 Smalc ..... H01L 23/3738 29/890.03
2003/0155103 A1 * 8/2003 Barten ..... F28F 3/025 165/80.3
2005/0189647 A1 * 9/2005 Sung ..... H01L 23/373 257/720
2006/0113546 A1 * 6/2006 Sung ..... H01L 21/02595 257/77
2007/0053168 A1 * 3/2007 Sayir ..... H01L 23/3672 361/718
2008/0085403 A1 * 4/2008 Sayir ..... H01L 23/373 428/212
2008/0128067 A1 * 6/2008 Sayir ..... H01L 23/373 156/60
2009/0145581 A1 * 6/2009 Hoffman ..... H01L 23/473 165/80.3
2010/0139885 A1 * 6/2010 Hoffman ..... F28D 17/02 165/7
2012/0043067 A1 * 2/2012 Huang ..... H01L 21/4878 165/185
2014/0034279 A1 * 2/2014 Lin ..... B23P 15/26 165/185
2017/0115073 A1 * 4/2017 Knox ..... F28F 21/082
2017/0117208 A1 * 4/2017 Kasztelan ..... H01L 23/36
2017/0271229 A1 * 9/2017 Santos ..... H01L 33/62

* cited by examiner

COMPOSITE HEAT SINK HAVING ANISOTROPIC HEAT TRANSFER METAL-GRAPHITE COMPOSITE FINS

FIELD OF THE INVENTION

The present invention relates to composite heat sinks and, more particularly to server heat sinks with anisotropic heat transfer properties in metal-graphite composite fins.

BACKGROUND

With the increased need for heat dissipation from electronic devices, thermal management becomes an increasingly important element of the design of electronics. Both reliability and life span of components are related to the component temperature. Therefore, in order to maximize component lifetime and reliability operating temperature control is crucial.

Increasing power densities and higher levels of integration will soon overload existing system thermal designs. Typically, electronic assemblies include a variety of materials, such as metals, semiconductors and polymers with a range of different material characteristics. In order to work optimally, the thermal conductivity, weight and coefficient of thermal expansion of the materials must be well-optimized within the components themselves in order to control the performance of electronic assemblies including these components. The excessive heat generated during operation of these components not only harms their own performance, but also degrades the performance and reliability of the overall system in which may even lead to system failure.

In order to dissipate heat from electronic components, a variety of heat sinks are employed in electronic assemblies. Typically, a heat sink is made from one or more metals, particularly copper and aluminum, due to these metals' stability and their high heat capacity. Copper and aluminum heat sinks often include fins or other specific structures to increase the surface area for heat dissipation; when air passes across or through the fins, heat is transmitted from the fins to the surrounding air. Aluminum-based heat sinks are used when weight is considered a critical design factor, while copper-based heat sinks are used when thermal conductivity is considered to be the more important factor. The density of pure copper is 8.98 g/cm$^3$ while the density of pure aluminum is 2.70 g/cm$^3$; although aluminum is much lighter than copper, this density still results in considerable weight carried by an electronic assembly incorporating copper and aluminum heat sinks.

Thus, there is a need in the art for improved heat sinks that are lighter and can more efficiently transfer heat from electronic components to the surrounding atmosphere.

SUMMARY OF THE INVENTION

The present invention provides a server heat sink with metal (e.g., aluminum or copper)-graphite composite heat sink fins bonded to a metal base. The metal-graphite fins have a thermal conductivity of up to 650 W/mK (which is 1.7 times higher than copper having a thermal conductivity of 380 W/mK), and are light in weight with a density in the range of 3.1-3.5 g/cm$^3$ (which is at least 2.5 times lighter than copper with a density of 8.96 g/cm$^3$). The composite fins also have a low coefficient of thermal expansion of $4.65\times10^{-6}$/K (which is at least 3.5 times lower than copper with a coefficient of thermal expansion of $16.5\times10^{-6}$/K). The composite may be formed by a Spark Plasma Sintering (SPS) process, which can align the graphite in a single direction, perpendicular to the pressure applied during sintering, forming a composite with anisotropic (directional) heat transfer properties.

More specifically, the present invention provides a composite server heat sink with a metal base having a thermal conductivity of at least 200 W/mK. Plural fins extend from the metal base, each fin having an anisotropic thermal conductivity in a range of approximately 300 to 650 W/mK in a longitudinal direction of the fin and less than approximately 30 W/mK in a widthwise direction of the fin. Each fin includes graphite in an amount of approximately 45-70 wt. %, diamond in an amount of approximately 2.5 to 10 wt. % with the balance comprising a metal selected from one or more of copper and aluminum. To create the anisotropic thermal properties, the graphite is aligned along the longitudinal direction of the fin.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

DETAILED DESCRIPTION

Figure 1A:
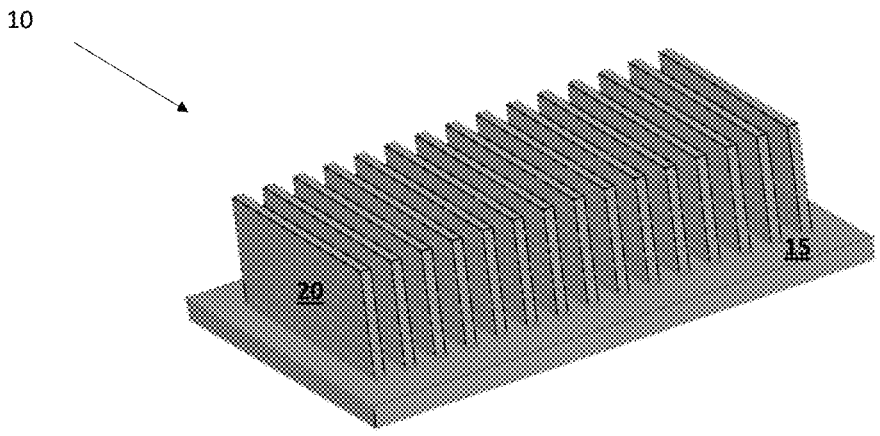
FIGS. 1A-1B depict rectangular and circular heat sinks.

The present invention improves the thermal conductivity of heat sink material while reducing the density of the heat sink material to create high-thermal-conductivity, low-weight heat sinks. To this end, large percentages of a carbon material such as graphite are used along with metals to create a heat sink material. Graphite is a 2-dimensional carbon-based material that can be processed to create highly anisotropic heat transfer properties; thus, heat sinks may be designed that transfer heat in specific and selected directions. In addition, carbon/graphite materials are low density, thus providing a lower-weight heat sink component than conventional metals, such as copper or aluminum. Graphite is composed of layers of flat hexagonal arrays of carbon atoms as seen in the inset of FIG. 1A. In the hexagonal arrays are sp$^2$ orbital hybrids and the atoms form in planes with each atom bound to the three nearest neighbors 120° apart. Owing to their specific sp$^2$ structure, superposed layers of laminated carbon atoms are weakly joined by Van der Waals forces, such that graphite exhibits anisotropic heat transfer properties (Tc in X-Y plane: 900-1000 W/mK; Tc in Z-plane: <50 W/mK). Due to this planar hexagonal structure, graphite is brittle with separable layers; this lack of structural integrity limits their application in thermal management devices such as heat sinks.

Unlike two-dimensional hexagonal arrays of carbon atoms, three-dimensional carbon atom structures, such as diamond, are good thermal conductors in all directions (isotropic heat transfer properties) because of the strong covalent binding and low photon scattering. The thermal conductivity of diamond has been measured to be approximately 2200 W/mK. However, it is difficult to manufacture heat sink components from pure diamond or diamond components since diamond components are difficult to cut or polish. Diamonds are also not a cost-effective raw material. Further, it is difficult to incorporate diamond into metal composites (e.g., copper-based composites) since the interface between copper and diamond is weak.

Therefore, the present invention provides a series of aluminum or copper-graphite-diamond composites which make use of the anisotropic heat transfer properties of graphite, formulated with the thermal conductive metals, such as aluminum or copper with diamond additives (approximately 2-10 wt. %), to develop highly thermally conductive composites with desirable thermal dissipating properties (up to approximately 650 W/mK in a single direction).

Figure 1B:
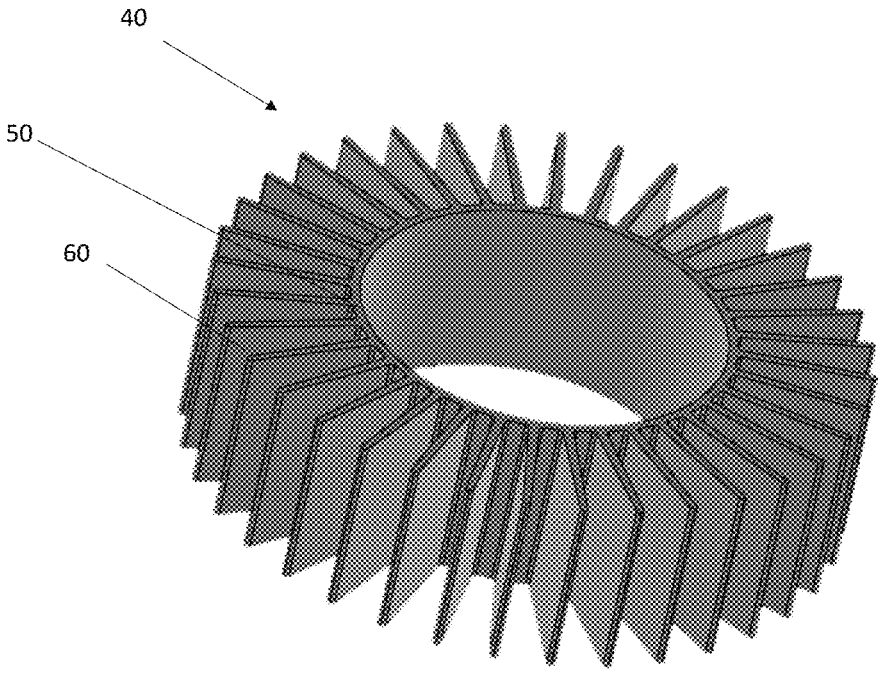

FIG. 1A is a photograph of a heat sink 10 according to an embodiment of the present invention. The heat sink 10 of FIG. 1A has a base 15 with a plurality of fins 20 extending in a direction substantially perpendicular to the base 15. The heat sink 10 is a rectangular heat sink that may be used with a variety of planar devices such as semiconductor devices and integrated circuits. FIG. 1B depicts an alternative, circular heat sink 40 according to another embodiment of the present invention. In the circular heat sink 40, the base 50 has a cylindrical configuration and the fins 60 extend in an approximately perpendicular direction to a tangent to the base cylinder at the point of fin attachment. The heat sink of FIG. 1B may be employed with LED elements. Additionally, circular heat sink components may be rotatable or form a fan structure.

It is noted that there are many configurations of heat sinks, including custom designs for specific system applications. In general, the materials used in the present invention may be applied to any heat sink structure that includes a base and fin-like projections extending from the base. As used herein, the term "fin" generally relates to any structure that projects from a base, and is typically flat and/or thin such that heat can be transmitted from the fin to the surrounding atmosphere. It can be straight or curved or have an irregular shape to fit a particular space.

Figure 1C:
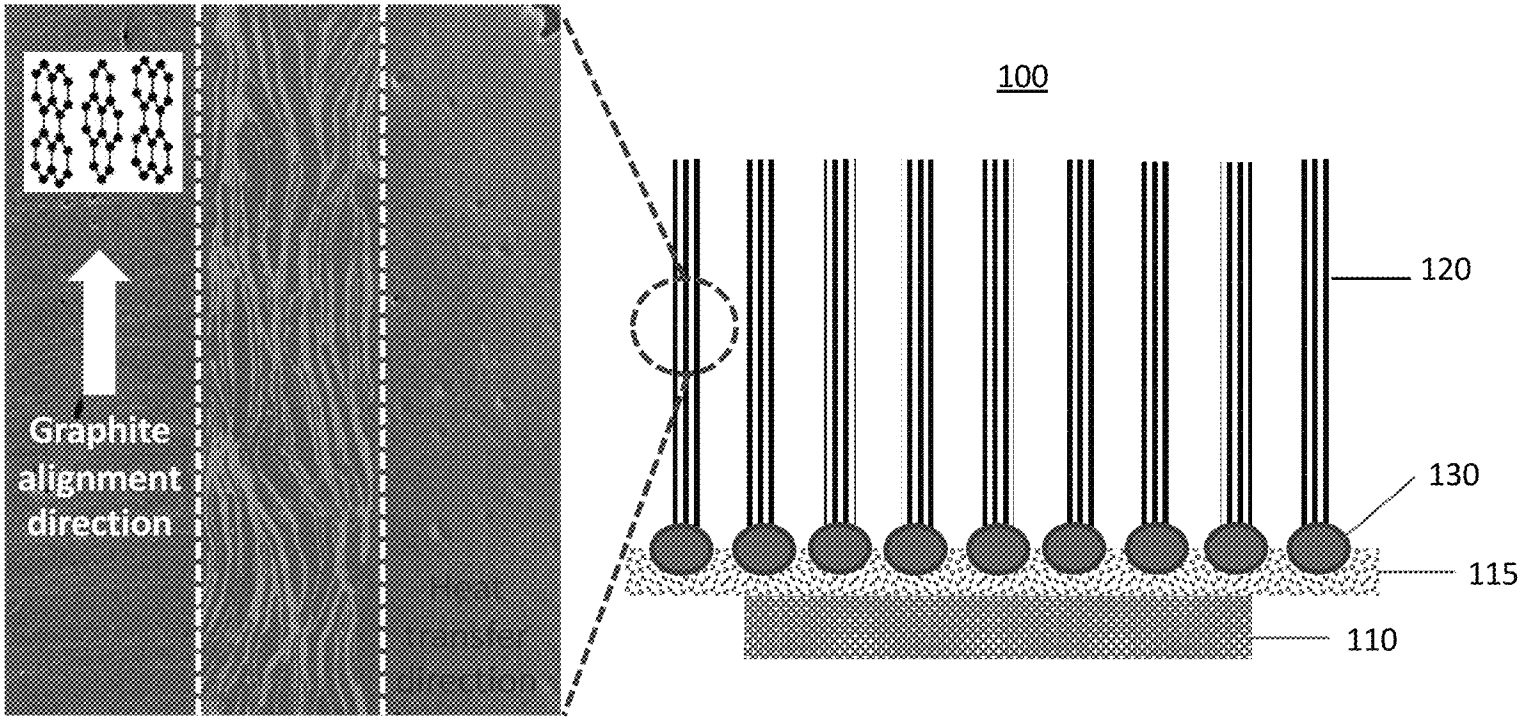
FIG. 1C schematically depicts components of an exemplary heat sink according to an embodiment.

FIG. 1C schematically depicts a heat sink 100 according to the present invention. Heat sink 100 includes plural bases, a base 110 that may be a metal such as copper or aluminum, and another base/wide plate 115 that may be a metal such as copper or aluminum and may be the same material as the base 110 or different from the base 110. Composite fins 120 extend from the base 115 and exhibit anisotropic conductivity in the longitudinal direction of the fins such that heat can be conducted away from the base. The fins 120 may be attached to the base through a variety of techniques including adhesive bonding, welding, mechanical fasteners or any other technique that can secure the composite material to the base metal material. In FIG. 1C, an epoxy adhesive 130 adheres the fins to the base 115, such as a thermally and electrically conductive silver epoxy resin.

In the present invention, the composite metal fins include graphite in an amount from approximately 45 wt. % to approximately 70 wt. %. The graphite may be natural or synthetic graphite and may be in the form of flakes, powders, or fibers. Graphite/carbon nanotubes may also be used. To enhance the thermal conductivity of the composite fins, diamond particles have a size of approximately 1.0 to approximately 5.0 microns are included in an amount from approximately 2.5 wt. % to approximately 10 wt. %. The balance of the composite includes a metal binder phase such as aluminum or copper and optional additives including small quantities of alloying metals or materials that enhance the bonding between the metal and graphite and between the metal and diamonds. Such additives or materials may include zinc, tin, silicon, nickel, titanium, etc. Additionally, the diamonds may be surface treated with acid, such as sulfuric acid and nitric acid, in a ratio of 3:1 to 1:0, or oxygen plasma treatment in order to enhance the bonding with a metal phase.

In order to bind the metal, graphite, and diamond components together, various composite integration techniques may be used. In general, the components are in powder or particulate form and may be sintered together. Sintering using heat and, optionally, pressure is used to fuse the particles together, generally without melting any of the components. During sintering, diffusion of atoms occurs among the particles to join adjacent particles to each other. Various powder metallurgy techniques can be applied to form the composite fins such as hot isostatic pressing, dynamic (shock) consolidation, and electric-current assisted sintering. Any technique that can fuse the metal, graphite, and diamond components together may be used to form the composite fins of the present invention.

In one embodiment, a form of electric-current assisted sintering called spark plasma sintering (SPS) may be used to form the composite fins. In SPS, a powder compact of the raw materials (metal powder, graphite, diamond) is placed in a graphite die and a DC or AC electric current is applied to the graphite die to rapidly heat the compact. The heating rate is extremely fast, on the order of 1000K/min. During the sintering, a load may optionally be applied; this load creates an orientation of the graphite particles in a direction perpendicular to the applied load. The alignment is along the longitudinal direction of the fin in order to enhance the thermal transfer from the base of the heat sink to the surrounding atmosphere of the fins. Details of the sintering process for various compositions is set forth in the Examples, below.

Figure 3:
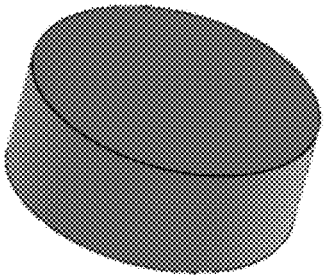
FIG. 3 is a photograph of a copper-graphite-diamond composite following SPS sintering.
Figure 8:
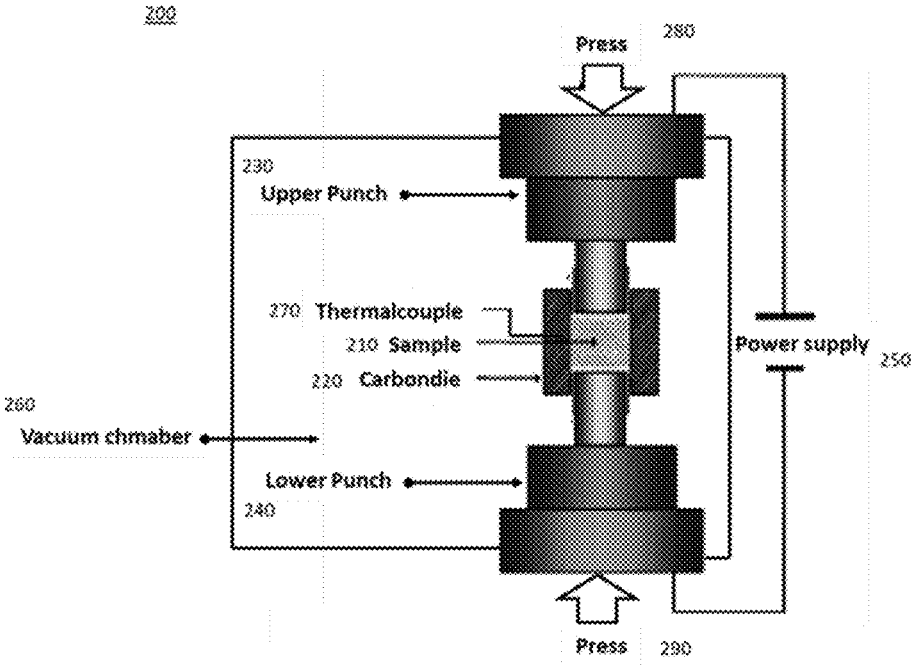
FIG. 8 is a schematic diagram of a spark plasma sintering system used to create composite fin material in an embodiment of the present invention.

FIG. 8 depicts a spark plasma sintering system that may be used to manufacture the composite fins. In FIG. 8, the components are placed at position 210 within a carbon die/crucible 220. Upper punch 230 and lower punch 240 compact the sample through press 280 and 290. Power supply 250 applies an AC or DC current to the carbon die as the material components are compacted. An example of an as-formed sample from the system of FIG. 8 is depicted in FIG. 3.

The Examples set forth below provide additional processing conditions and tests of products and are included to further aid in the understanding of the present invention but are not intended to limit its features.

Example 1: Aluminum Graphite 15% Composite

Natural graphite with a size of 32 mesh or above, and carbon content of over 99% along with aluminum powder with purity of 99.9% were mixed using a ball milling system at 250-500 rpm until a homogeneous composite mixture was achieved. The powder mixture was loaded into a graphite mold and sealed for a spark plasma processing (SPS) process. A 1050-SPS system Sumitomo Coal Mining was used; sintering was performed at a temperature of 500-620° C. and held for 5-10 minutes under an axial pressure of 20-60 MPa. A composite with a graphite mass fraction of 15% was prepared by controlling the amount of aluminum and graphite powder. A Netzsch LFA 467 laser flash thermal conductivity tester was used to characterize the thermal diffusivity of the composite and the test results are summarized in Table 1.

TABLE 1

Thermal conductivity and hardness test results for aluminum, copper and aluminum graphite composites

| | Pure Al | Pure Cu | Al25 15G | Al26 25G | Al27 35G | Al28 45G | Al14-1 55G | Al16-1 70G | Cu-1 55G-D |
|---|---|---|---|---|---|---|---|---|---|
| Graphite content(wt. %) | — | — | 15 | 25 | 35 | 45 | 55 | 70 | 55 |
| Hardness (Shore D) | 94.2 | 96.3 | 92.0 | 86.5 | 84.8 | 77.6 | 72.4 | 69.6 | 68 |
| Tc (W/mK) | 214 | 379 | 138 | 124 | 200 | 221 | 236 | 364.4 | 646.6 |

Example 2: Aluminum Graphite 25% Composite (Al26)

Similar to Example 1, a composite with graphite mass fraction of 25% was prepared by controlling the amount of aluminum powder to graphite powder. Netzsch LFA 467 laser flash thermal conductivity tester was used to characterize the thermal diffusivity of the composite and the test result was summarized in Table 1.

Example 3: Aluminum Graphite 35% Composite (Al27)

Similar to Example 1, a composite with graphite mass fraction of 35% were prepared by controlling the amount of aluminum powder to graphite powder. Netzsch LFA 467 laser flash thermal conductivity tester was used to characterize the thermal diffusivity of the composite and the test result was summarized in Table 1.

Example 4 Aluminum Graphite 45% Composite (Al28)

Similar to Example 1, the composite with graphite mass fraction of 45% was prepared by controlling the amount of aluminum powder to graphite powder. Netzsch LFA 467 laser flash thermal conductivity tester was used to characterize the thermal diffusivity of the composite and the test result was summarized in Table 1.

Example 5 (5a-5d) Aluminum Graphite 55% Composite, Diamond 2.5-10 wt. % (Al14-1)

Figure 2A:
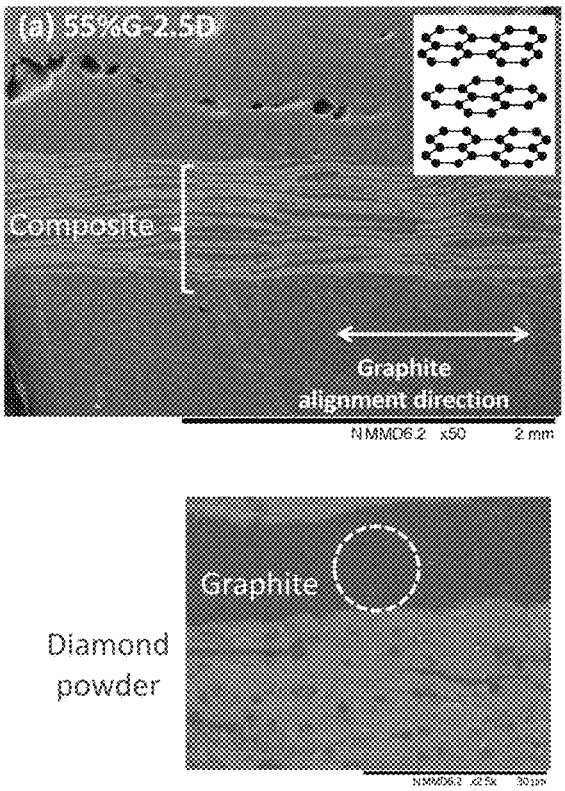
FIGS. 2A-2B are SEM photomicrographs of cross sections of metal-graphite composites with graphite content of (a) 55% of graphite 2.5% of diamond (FIG. 2A) and 70% of graphite 10% of diamond (FIG. 2B), respectively.

Similar to Example 1, the composite with graphite mass fraction of 55% was prepared by controlling the amount of aluminum powder to graphite powder. Netzsch LFA 467 laser flash thermal conductivity tester was used to characterize the thermal diffusivity of the composite. This is listed as sample 5*a* in Table 3. In addition, 2.5, 5.0 and 10 wt. % of surface modified diamonds were added into the formulation to give the thermal conductivity test result for 5b-5d (Table 3). FIG. 2A shows the SEM cross section of the aluminum-graphite diamond composite with graphite well-aligned in the longitudinal direction of the fin (perpendicular to the direction of applied pressure) throughout the composite while aluminum was evenly distributed which was bonded between the graphite flakes with good adhesion.

Example 6 (6a-6d) Aluminum Graphite 70% Composite, Diamond 2.5-10% (Al16-1)

Figure 2B:
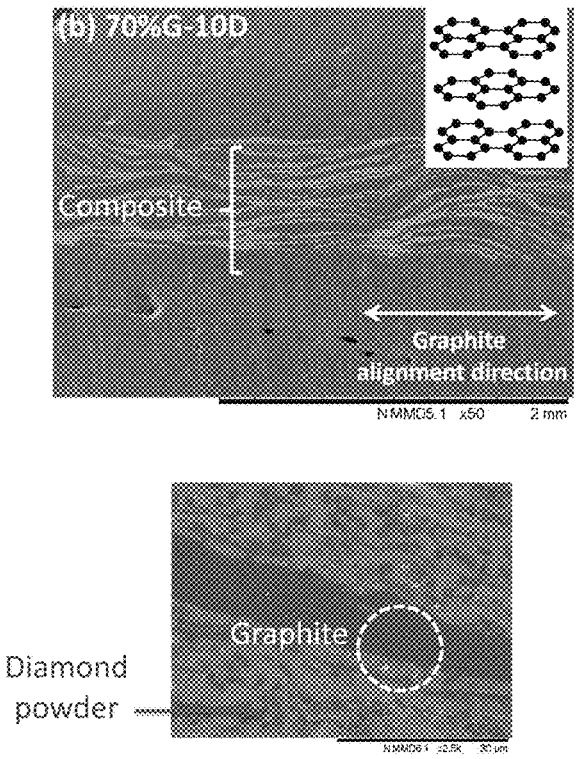

Similar to Example 1, the composite with graphite mass fraction of 70% was prepared by controlling the amount of aluminum powder to graphite powder (sample 6*a*, Table 2) Netzsch LFA 467 laser flash thermal conductivity tester was used to characterize the thermal diffusivity of the composite. In addition, 2.5, 5.0 and 10 wt. % of surface modified diamonds were added into the formulation to give the thermal conductivity test result for samples 6*b*-6*d* (Table 3). FIG. 2B shows the SEM cross-section of the aluminum-graphite diamond composite with the graphite being well-aligned in the longitudinal direction of the fin (perpendicular to the direction of the applied force) throughout the composite while copper was evenly distributed which was bonded between the graphite flakes with good adhesion.

Example 7: Copper Graphite 55% Composite, Diamond 2.5-10%

Natural graphite with a size of 32 mesh or above, carbon content of over 99% was used as purchased. Similarly, copper powder with purity of 99.9% was used. The graphite powder and copper powder were mixed with a ball milling system at 250 rpm until a homogeneous composite mixture was achieved. In addition, 2.5, 5.0 and 10 wt. % of surface modified diamonds were added into the formulation. The powder mixture was then loaded into a graphite mold which was sealed for spark plasma processing (SPS) process. A 1050-SPS system was used at 650-780° C. and maintained for 5-10 minutes under an axial pressure of 20-60 MPa. The composite with a graphite mass faction of 55% was prepared by controlling the amount of copper, graphite powder and surface modified diamonds. A Netzsch LFA 467 laser flash thermal conductivity tester was used to characterize the thermal diffusivity of the composite and the test result is summarized in Table 2.

Example 8: Comparative Example Copper, Aluminum

For comparison, aluminum and copper samples were also prepared under the same SPS condition with copper and aluminum powder, respectively. A Netzsch LFA 467 laser flash thermal conductivity tester was used to characterize the thermal diffusivity of the aluminum and copper. The test result is summarized in Table 1 and Table 2.

Example 9: Heat Sink Fabrication

Figure 4:
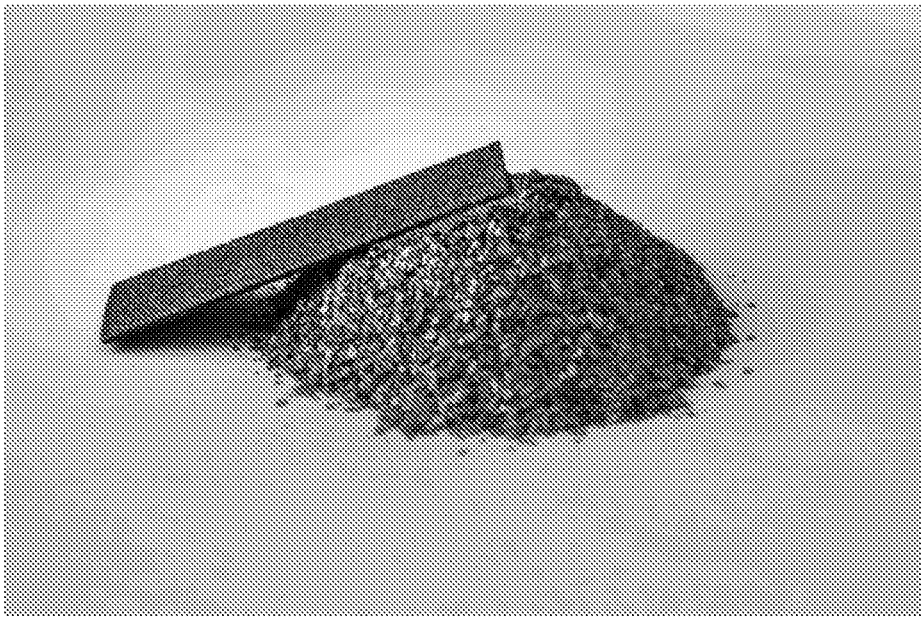
FIG. 4 is a photograph of a copper-graphite diamond composite fin as cut by a water jetting machine.

FIG. 3 depicts the copper-graphite composite formed by the SPS process. The composite was further modified by a water jetting machine. The composite was cut into a specific size and graphite orientation, which were aligned in an upright position (FIG. 4) with the graphite aligned in a longitudinal direction with respect to the fin. Composite fins with the size of 50 mm(w)*20 mm(h)*1 mm(t) were prepared and bonded to the metal base plate by silver epoxy which was cured at 150° C. for 30 mins (FIG. 1A).

Example 10: Hardness Measurement

Shore D hardness testing was used to evaluate the hardness change of the composites from 15%-70 wt % of graphite. It was found that upon increasing the weight % of graphite powder in the aluminum composite to 15%, the hardness of the composite drop from 96.3 (pure Al) to 92.0, while as the graphite powder increases to 55%, the hardness of the composite drop to 72.4. Further increasing the graphite powder to 70%, the hardness dropped to 69.6.

For the copper composites, 55 wt. % of graphite gave a hardness data of 68.0 (not disclosed in the specification), which is slightly lower than that of the aluminum composite. Table 1 summarizes the hardness data for the aluminum graphite composites.

Example 11: Thermal Conductivity and Thermal Diffusivity

A Netzsch LFA 467 laser flash thermal conductivity tester was used to measure the thermal diffusivity (Td) of the composites, while the thermal conductivity (Tc) was calculated based on the following equation: Tc=Td*Cp*d where Cp is the specific heat capacity of composite and d is the density of the composite. From the test results listed in the Table 2, it was found that the Td and Tc dropped below the material intrinsic values and reached a balance at graphite equal to 35 wt. %. Further increasing the graphite content to 55 wt. % will boost the Tc up to 236 W/mK while 70 wt. % graphite gives a Tc of 364.4 W/mK. It was found that all of the composites showed anisotropic heat transfer properties with in-plane Tc substantially higher than the through plane Tc which aligned with the SEM results of FIG. 2A-2B and demonstrated the greater heat transfer along the graphite orientation/longitudinal direction. The in-plane Tc further increases upon further modifying and formulating the composite with surface modified diamonds (Table 3). Upon adding 10% of surface modified diamonds in 55% graphite formulation, the Tc will further increase to 348.7 W/mK; similar findings have also been made in 70 wt. % graphite formulations, where the ultimate Tc is 448.6 W/mK.

Based on the same testing method, a copper composite with 55 wt. % of graphite content and surface modified diamonds has an in-plane Tc of up to 650 W/mK.

Besides the considerable thermal advantages of the composite, the substantial reduction in material density accounts for a weight reduction of the composite heat sink. With 70% graphite loading in an aluminum composite, the weight can be reduced by 15%. While 55% of graphite loading in a copper composite, the weight can be further reduced by 2.5 times. Table 2 summarizes the density data of the SPS (pure Al, pure Cu) and (Al-G, Cu-G) diamond composites respectively.

TABLE 2

Thermal diffusivity, thermal conductivity, material density, coefficient of thermal expansion test results for aluminum graphite composite (examples 1-6) and copper graphite composite (example-7)

| Example | 8 | 1 | 2 | 3 | 4 | 5 | 6 | 7 | 8 |
|---|---|---|---|---|---|---|---|---|---|
| | SPS (Pure Al) | Al25 15G | Al26 25G | Al27 35G | Al28 45G | Al14 55G 10D | Al16 70G 10D | Cu-1 55G-D | SPS (Pure Cu) |
| Density ($g/cm^3$) | 2.685 | 2.571 | 2.468 | 2.427 | 2.321 | 2.244 | 2.229 | 3.239 | 8.960 |
| Coefficient of thermal expansion (ppm/K) | 13.1 | — | — | — | — | 6.9 | — | 4.7 | 16.5 |
| Cp(kJ/(kgK)) | 0.880 | 0.855 | 0.838 | 0.821 | 0.804 | 0.781 | 0.758 | 0.560 | 0.385 |
| Thermal diffusivity ($mm^2/s$) // | 90.8 | 62.8 | 59.8 | 130.2 | 183.4 | 196.5 | 362.8 | 356.5 | 105 |
| Avg. Thermal conductivity (W/mK) // | 214.5 | 137.9 | 123.6 | 199.8 | 220.6 | 348.7 | 448.6 | 646.6 | 362.2 |
| Thermal diffusivity ($mm^2/s$) perpend. | 88 | 7.4 | 5.7 | 7.7 | 6.4 | 5.5 | 13.3 | 19.1 | 110 |
| Thermal conductivity (W/mK) perpend. | 207.9 | 16.3 | 11.8 | 15.3 | 11.9 | 9.6 | 22.6 | 34.6 | 379.4 |

TABLE 3

In plane thermal conductivity of aluminum metal composite with 0%, 2.5%, 5.0% and 10% surface modified diamonds

| Sample | 5a | 5b | 5c | 5d |
|---|---|---|---|---|
| Composition | 55G-0D | 55G-2.5D | 55G-5.0D | 55G-10D |
| Thermal conductivity (W/mK) // | 236.0 | 314.2 | 304.2 | 348.7 |
| **Sample** | **6a** | **6b** | **6c** | **6d** |
| Composition | 70G-0D | 70G-2.5D | 70G-5.0D | 70G-10D |
| Thermal conductivity (W/mK) // | 364.4 | 357.5 | 377.0 | 448.6 |

Example 11: Thermal Imaging Tests

Figure 5:
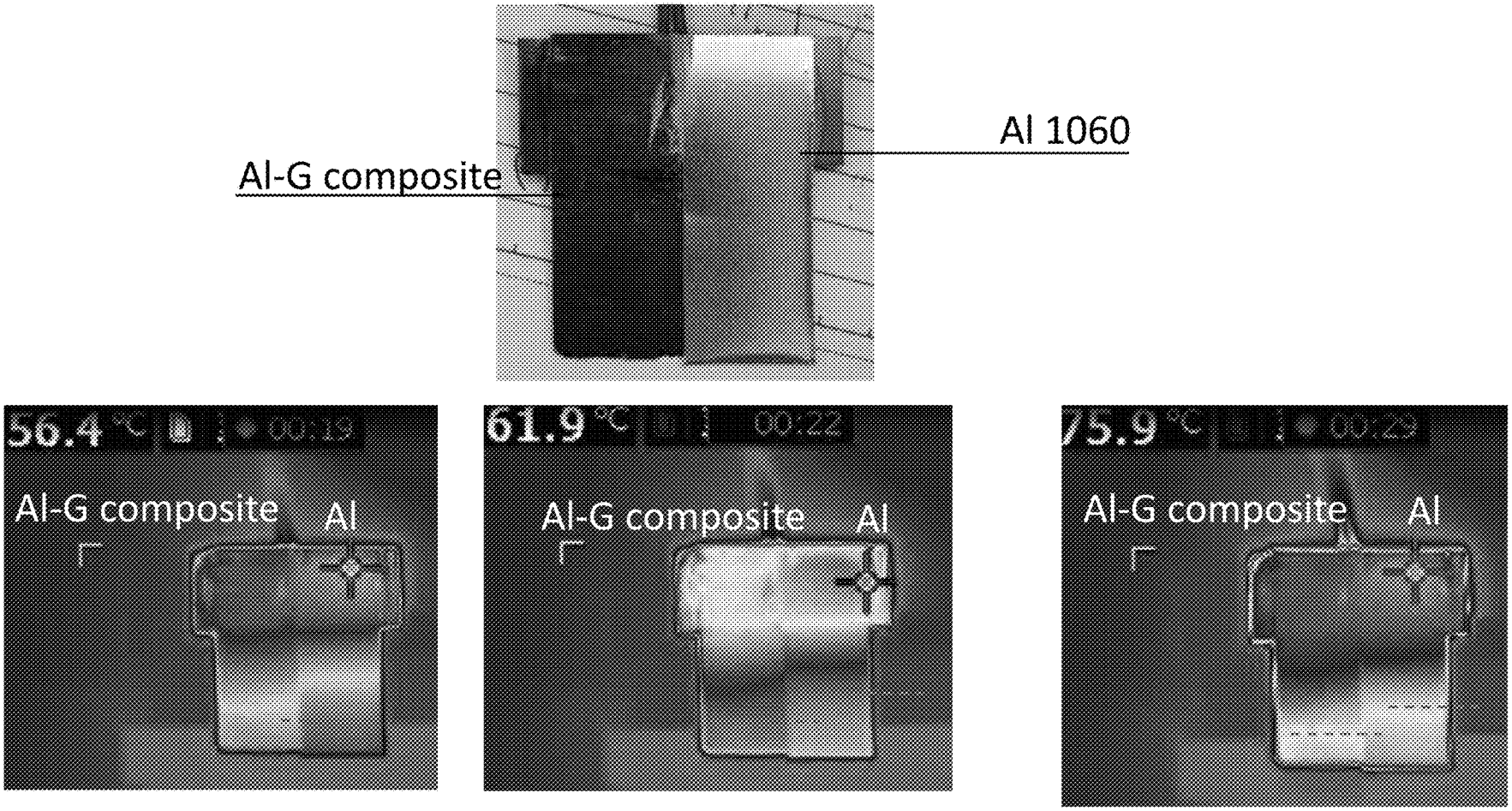
FIG. 5 is a thermal imaging test for an aluminum-graphite-diamond composite (55% graphite) compared to aluminum.
Figure 6:
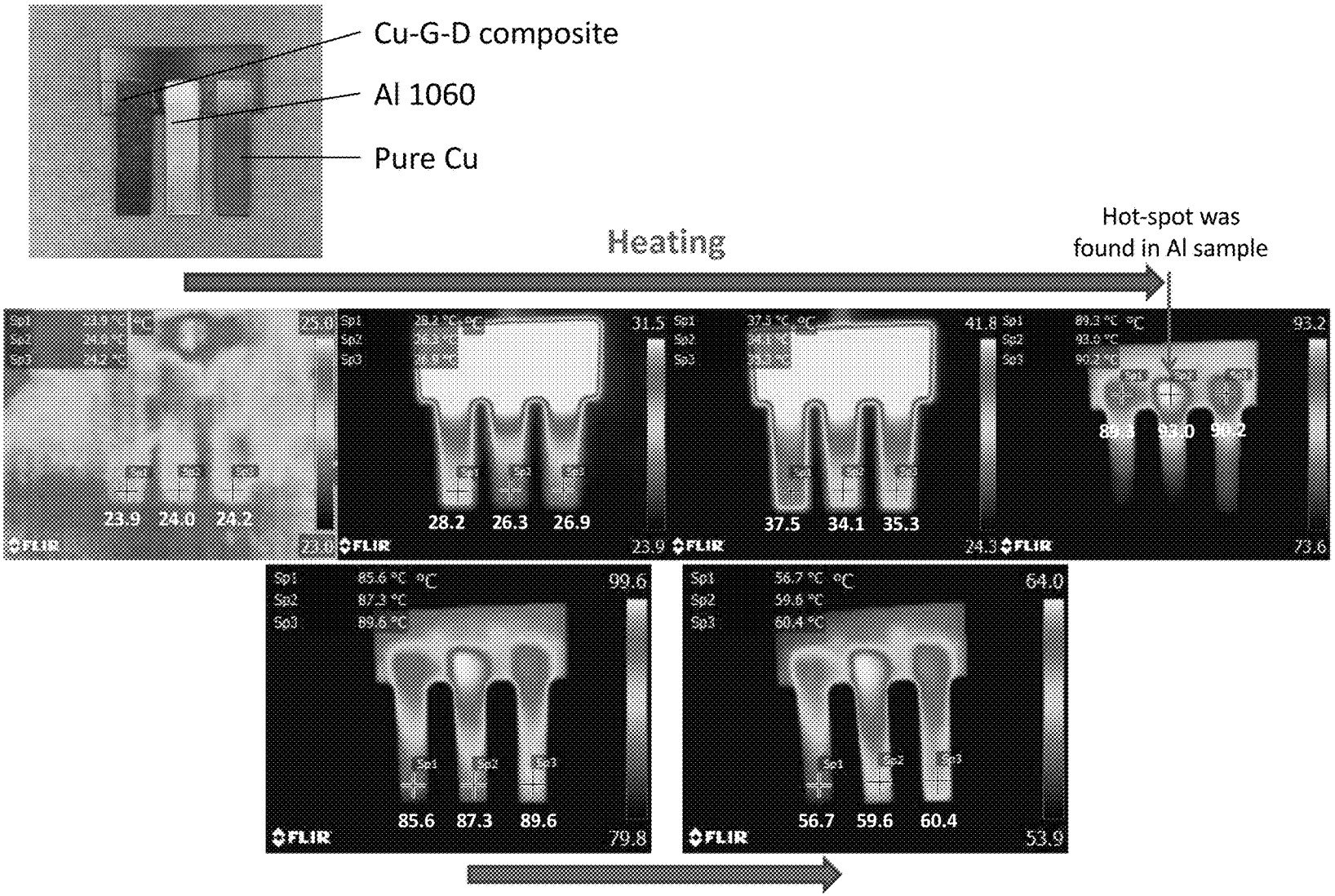
FIG. 6 is a thermal imaging test for a copper-graphite diamond composite (55% graphite) compared to aluminum and copper.

Thermal imaging tests were used to compare the heat transfer properties of the composite to pure metal. For a better comparison, bulk materials (aluminum fins and copper fins) were used to perform the thermal diffusion study. An IR camera was used to monitor the heat diffusion rate of each composite and a heat pad was used to provide a constant heat source during the test. From FIG. 5, it was found that the Al-G-D fin (55%) performance was better than that of pure Al fin. From FIG. 6, the Cu-G-D fin (55%) showed the best diffusion rate among all samples, including a higher thermal diffusion rate along the sample (Cu-G-D>Cu>Al). Hotspot was found in heater-Al sample connection point with the $T_{max}$ of 93° C. While in the cooling process (heater off), Gu-G-D also shows a more effective thermal dissipation effect, with the temperature is the lowest among all samples ($T_{max}$: Cu-G-D<Al<Cu), which also indicates the potential advantages of using carbon metal composite in thermal management products and aligned with the thermal conductivity test results as measured in the laser flash study.

Figure 7:
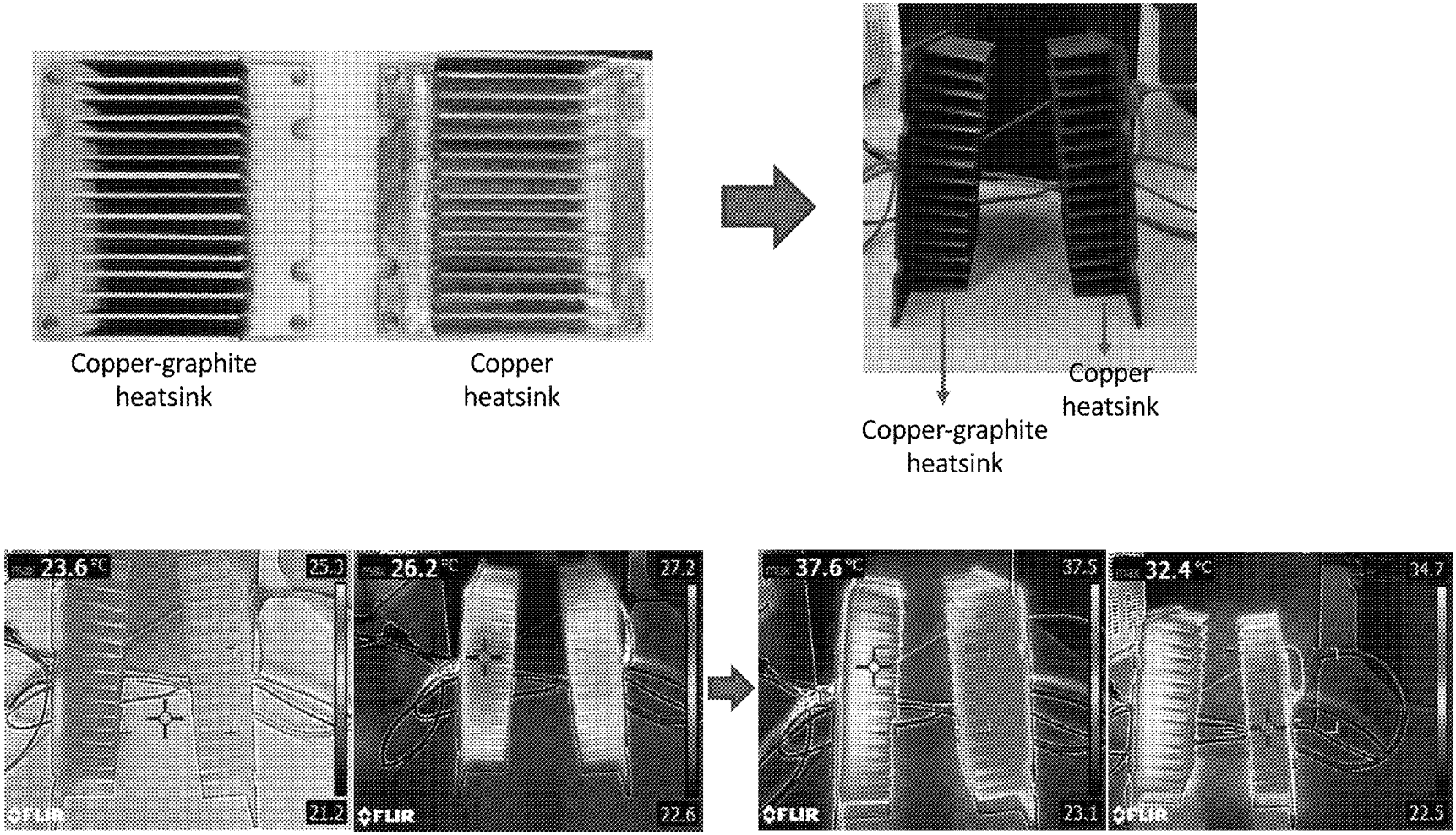
FIG. 7 is a thermal imaging temperature study for a copper-graphite-diamond composite (55% graphite) heat sink compared to a copper heat sink.

A similar study was performed on heat sinks; a control heat sink was fabricated from pure copper and the heating source was connected to the same power supply. Both heat sinks were cooled by natural convection with no cooling system applied. It was found that the Cu-G heat sink took a shorter time to achieve the maximum temperature under the same testing condition. Further, the maximum temperature achieved by the Cu-G fins is much higher than that of the Cu fins, indicating that heat transfer effect is more effective on the composites (FIG. 7).

Composite heat sinks and methods of fabricating composite heat sinks have been disclosed. It should be apparent, however, to those skilled in the art that many more modifications besides those already described are possible without departing from the inventive concepts herein. The inventive subject matter, therefore, is not to be restricted except in the spirit of the disclosure. Moreover, in interpreting the disclosure, all terms should be interpreted in the broadest possible manner consistent with the context. In particular, the terms "includes," "including," "comprises," and "comprising" should be interpreted as referring to elements, components, or steps in a non-exclusive manner, indicating that the referenced elements, components, or steps may be present, or utilized, or combined with other elements, components, or steps that are not expressly referenced.

The invention claimed is:

1. An anisotropic composite heat sink comprising:

a base comprising a metal having a thermal conductivity of at least 200 W/mK;

a plurality of anisotropic, pressure-aligned graphite, diamond, and metal composite fins extending from the metal base, each fin having an anisotropic thermal conductivity in a range of approximately 300 to 650 W/mK in a longitudinal direction of the fin with a thermal conductivity less than approximately 30 W/mK in a widthwise direction of the fin, each fin comprising graphite in an amount of approximately 45-70 wt. %, diamond having a diameter of approximately 1.0 to 5.0 microns in an amount of approximately 2.5 to 10 wt. % with the balance comprising a metal selected from one or more of copper and aluminum, wherein the graphite is aligned along the longitudinal direction of the fin.

2. The composite heat sink of claim 1, wherein the plurality of fins are bonded to the base by one or more thermally conductive resins with a thermal conductivity of at least 5 W/mK.

3. The composite heat sink of claim 1, wherein the fins are approximately perpendicular to the metal base.

4. The composite heat sink of claim 1, wherein the base comprises copper or aluminum.

5. The composite heat sink of claim 1, wherein the base is a plate with the plurality of fins extending from one or two sides thereof.

6. The composite heat sink of claim 1, wherein the base is a solid or hollow cylinder with the plurality of fins extending from a circumference of the cylinder.

7. The composite heat sink of claim 1, wherein the graphite is selected from one or more of natural graphite, synthetic graphite, or graphite fibers.

8. The composite heat sink of claim 1, wherein the graphite-diamond-metal fin material is formed from powder precursors sintered by a spark plasma sintering process.

9. The composite heat sink of claim 8, wherein the spark plasma sintering is performed at a temperature of approximately 400-780° C.

10. The composite heat sink of claim 9, wherein the spark plasma sintering is performed at a temperature of 25-400° C. by increasing the temperature by approximately 100° C/min and at a temperature of 400-780° C. by increasing the temperature by approximately 50° C/min, and maintaining a highest temperature for approximately 7-10 mins under an axial pressure of 30-70 MPa.

11. The composite heat sink of claim 1, wherein the diamond particles are surface treated with acid treatment with sulfuric acid and nitric acid in a ratio of 3:1 to 1:1 or oxygen plasma treatment to increase bonding to the copper and/or aluminum.

12. The composite heat sink of claim 1, wherein each of the plurality of fins has a coefficient of thermal expansion of approximately $6\times10^{-6}$/K or less.

* * * * *